US006520814B1

(12) United States Patent
Elias et al.

(10) Patent No.: US 6,520,814 B1
(45) Date of Patent: Feb. 18, 2003

(54) JET PROPELLED DEVICE

(75) Inventors: Richard Elias, Sherman Oaks, CA (US); Larry Sweet, West Covina, CA (US)

(73) Assignee: Sweet & Rich, Inc., Los Angeles, CA (US)

( * ) Notice: Subject to any disclaimer, the term of this patent is extended or adjusted under 35 U.S.C. 154(b) by 0 days.

(21) Appl. No.: 09/947,307

(22) Filed: Sep. 5, 2001

(51) Int. Cl.[7] ..... B63H 11/00
(52) U.S. Cl. ..... 440/38
(58) Field of Search ..... 440/38; 114/151

(56) References Cited

U.S. PATENT DOCUMENTS 3,372,667 A * 3/1968 Sweet ..... 440/38
3,503,356 A * 3/1970 Wilson ..... 440/38
4,115,888 A * 9/1978 Sievers ..... 440/38

* cited by examiner

*Primary Examiner*—Ed Swinehart
(74) *Attorney, Agent, or Firm*—Fish & Richardson P.C.

(57) ABSTRACT

A device coupleable to a remote source of pressurized fluid for producing fluid that can be discharged by the device and thereby propel the device over or through a surface. The device comprises a buoyant hull with one or more fluid communicators for directing fluid flow. A nozzle at the distal end of each fluid communicator creates a fluid discharge from the fluid communicator directed horizontally or at an angle away from horizontal. Flexible tubes connect the fluid communicators to the remote fluid source.

13 Claims, 3 Drawing Sheets

Tubing coupled to hull

Channels molded into hull

Channels molded into hull

JET PROPELLED DEVICE

TECHNICAL FIELD

This invention relates to a buoyant jet-propelled device, and more particularly to a buoyant toy that can be propelled over or through water or across surfaces such as concrete or grass by means of jet propulsion.

BACKGROUND

Most propelled car and boat toys and recreational water devices, such as jet-skis, use electric motors or internal combustion engines to propel them across terrain or water. The electric motors require expensive rechargeable batteries with limited life and long recharge times. The power these motors produce is limited, and typically these toys are slow and have limited entertainment value. Internal combustion engines are loud, heavy, and dirty. The fuel on which they run is flammable and generally unsafe for children. Moreover, motorized toys and recreational devices are generally too expensive and sophisticated for punishing use by children around a pool.

The present invention avoids these problems of durability, expense, and limited range and provides a device for use in water or on land that does not use fragile components or complex motors, yet is interactive, entertaining, simple to use, and durable.

DESCRIPTION OF DRAWINGS

Different aspects of the disclosure will be described in reference to the accompanying drawings herein.

Like reference symbols in the various drawings indicate like elements.

DETAILED DESCRIPTION

The details of one or more embodiments of the invention are set forth in the accompanying drawings and the description below. Other features, objects, and advantages of the invention will be apparent from the description and drawings, and from the claims.

Figure 1:
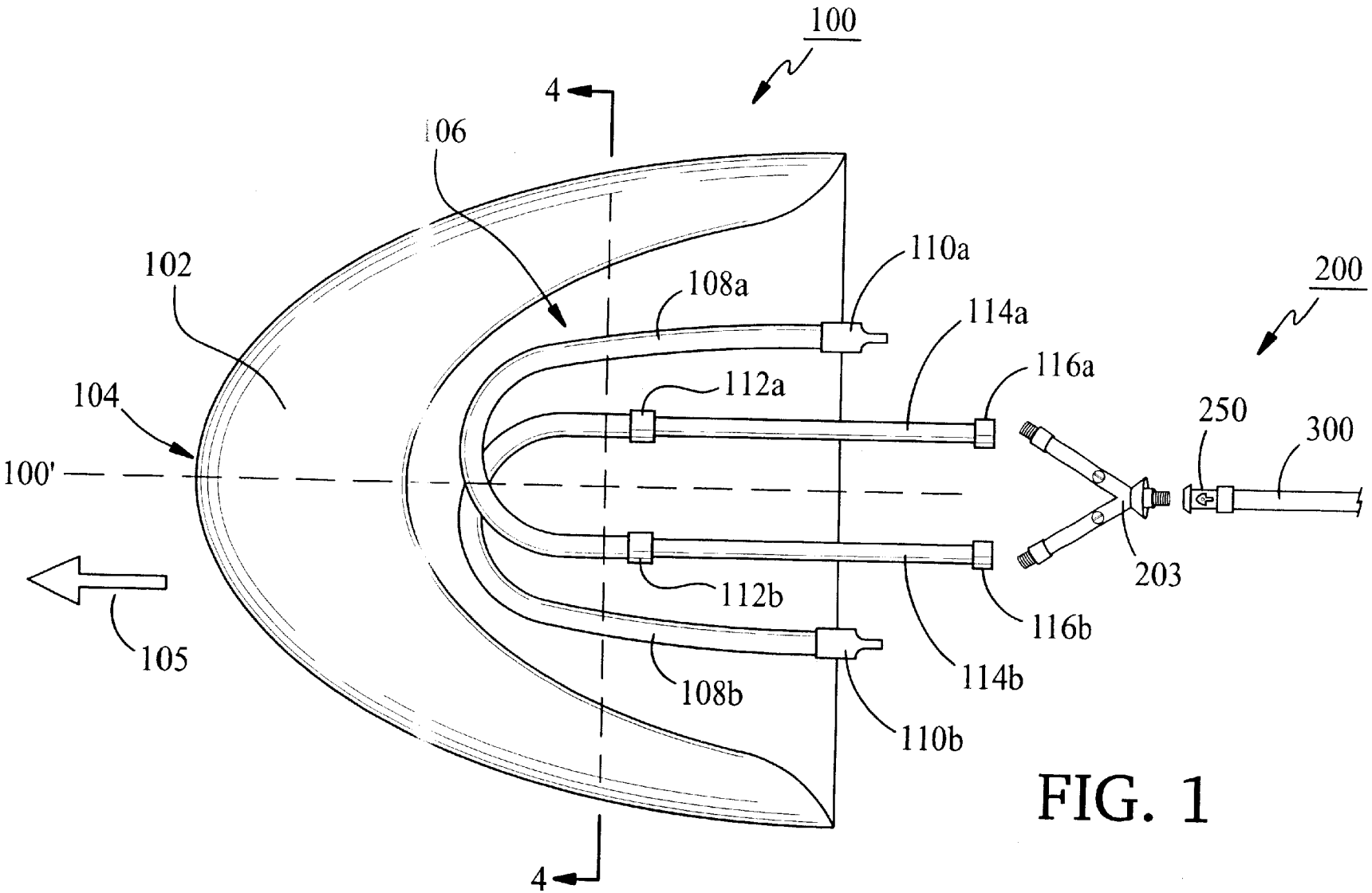
FIG. 1 is a top view of an embodiment of the present invention showing a buoyant hull, fluid communicators, jet nozzles, and a partial view of the tubes connecting the fluid communicators the assembly of FIG. 2.

FIG. 1 shows a top view of an embodiment of the present invention 100, a jet propelled water device. The device 100 has general application as a pool toy, but may be used as a toy or recreational vehicle in a pond or lake. The device 100 includes a buoyant hull 102, preferably substantially symmetrical in shape about longitudinal axis 100', having a bottom surface, and a durable, wedge-shaped bow 104 for enduring impacts and shielding fluid communicators 108 and jet nozzles 110 from frontal and side impact. The buoyant hull 102 may be constructed from light-weight, corrosion resistant material, for example, solid or hollow plastic, inflatable plastic or rubber, or Styrofoam. The buoyant hull 102 may be molded to resemble common or whimsical shapes ranging, for example, from a raft to a cigarette boat to a pontoon. The shape shown in FIG. 1 is intended merely as an example; many other shapes may be implemented, in known fashion.

Figure 4A:
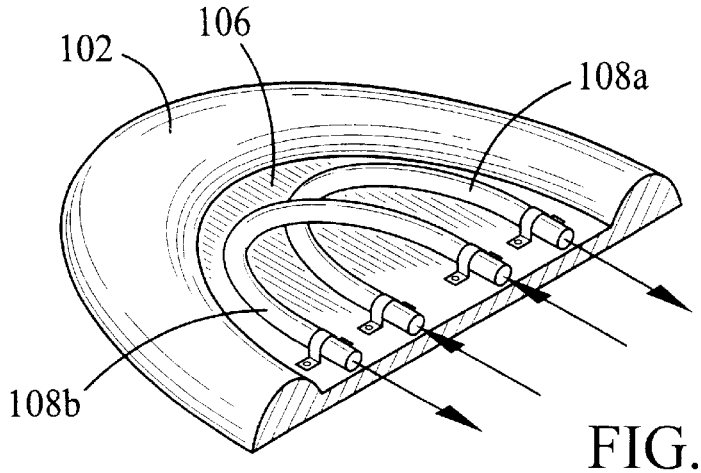
FIG. 4 provides perspective cut-away views of a number of possible ways that a buoyant hull can be connected with channels.
Figure 4B:
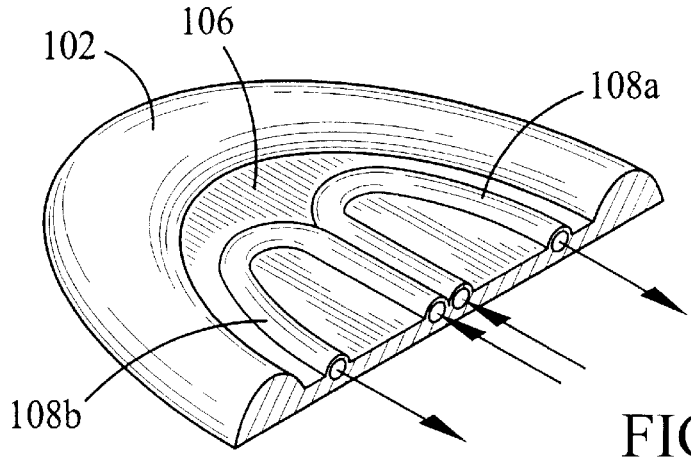
Figure 4C:
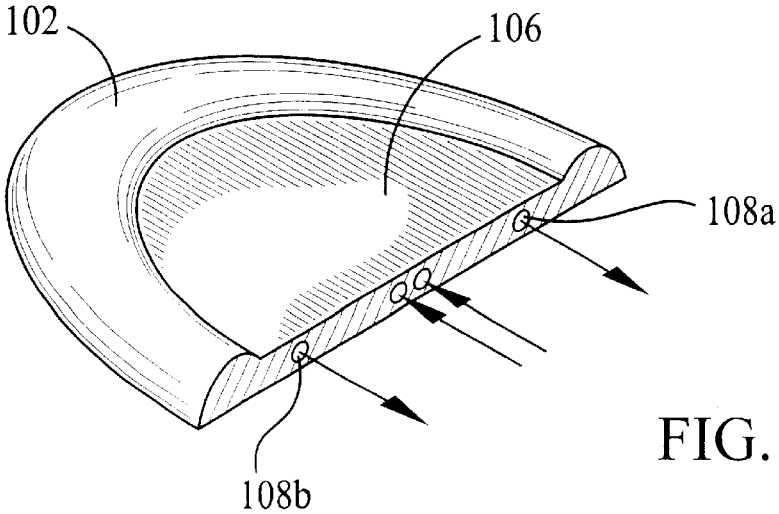

FIG. 1 also shows a pair of fluid communicators 108*a* and 108*b*, having substantially similar diameters, coupled to, or molded into, a recess 106 in the buoyant hull 102. FIG. 4 shows three examples of how the fluid communicators 108*a* and 108*b* may be formed. In FIG. 4(*a*) the fluid communicators 108*a* and 108*b* are tubes coupled to the buoyant hull 102 by any fastener, for example, screws, adhesives, clips, or snaps. In FIG. 4(*b*), the fluid communicators 108*a* and 108*b* are channels molded as part of the buoyant hull 102. The channels may also be molded separately from the buoyant hull 102 but coupled to the buoyant hull 102 by any fastener, for example, screws, adhesives, clips, or snaps. FIG. 4(*c*) shows another example of how the fluid communicators may be molded into the buoyant hull 102. Those skilled in the art will appreciate that other configurations and implementations may be used to form fluid communicators 108*a* and 108*b*.

The fluid communicators 108*a* and 108*b* direct water or other fluid (such as air) from a remote source (not shown) to jet nozzles 110*a* and 110*b* from tubes 114*a* and 114*b*. Recess 106 is preferably deep enough to allow the hull to flip over and rest on its top surface without pinching or collapsing tubes 114*a* and 114*b*. The fluid communicators 108*a* and 108*b* may be constructed of light-weight, corrosion resistant material, for example, plastic, aluminum, or stainless steel. In other embodiments, the device 100 may have a single fluid communicator or more than two fluid communicators, either having substantially similar diameters, or differing diameters to support different flow rates. In still other embodiments, the fluid communicators may protrude from the device 100 or remain recessed. Those skilled in the art will appreciate that other configurations and implementations will provide satisfactory performance while achieving the desired results, including allowing the fluid communicators to be directly coupled to a piece of tubing or hose 300, which in turn is coupled to a remote fluid source, without the use of tubes 114*a*, 114*b*.

A jet nozzle 110*a* or 110*b* may be connected with the distal end of each fluid communicator 108*a* and 108*b* in order to discharge fluid with sufficient velocity to propel the device 100. Jet nozzles 110*a* and 110*b* may be substantially similar and may be constructed of light-weight corrosion resistant material, for example, plastic, aluminum, or stainless steel. Any off-the-shelf nozzles having a configuration that can be used with the respective fluid communicator 108*a* or 108*b* will be suitable. Of course, those skilled in the art will appreciate that certain nozzle output profiles will provide greater thrust and thus greater velocity. The nozzle may be selected in accordance with the desired objectives of the designer to achieve speed or safety.

Figure 2:
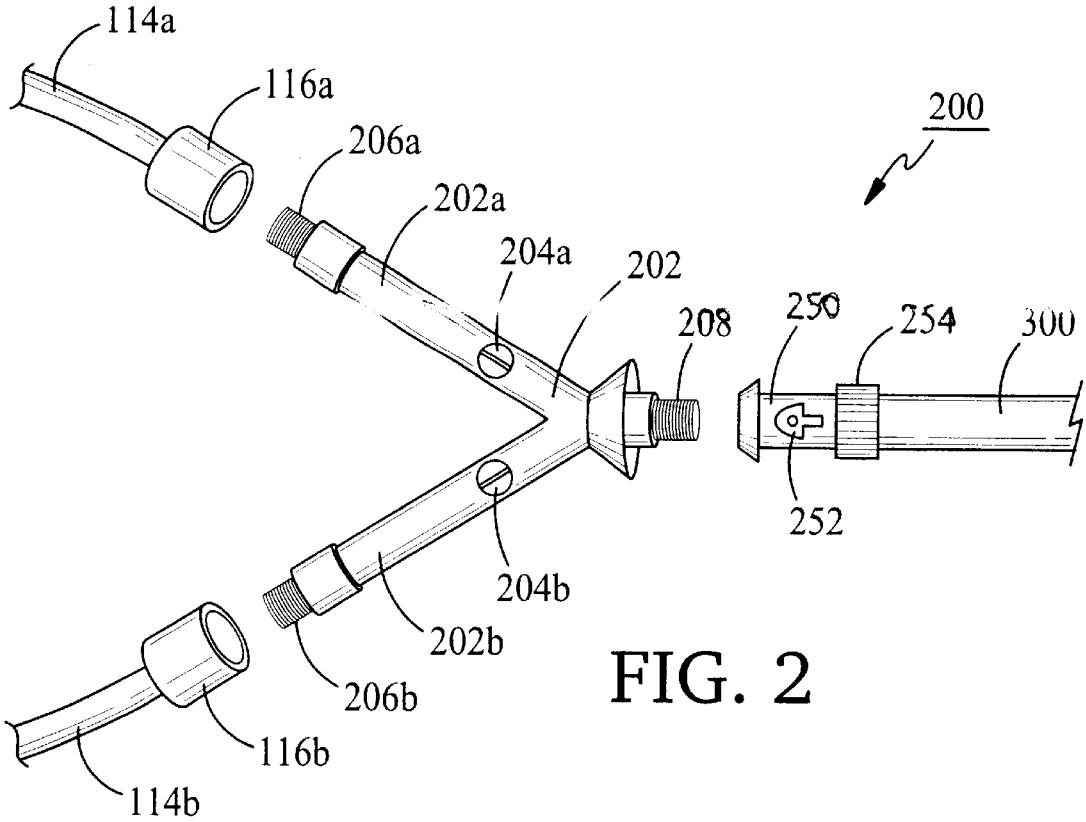
FIG. 2 is a perspective view of an assembly for coupling a water source to the tubes of FIG. 1.
Figure 3:
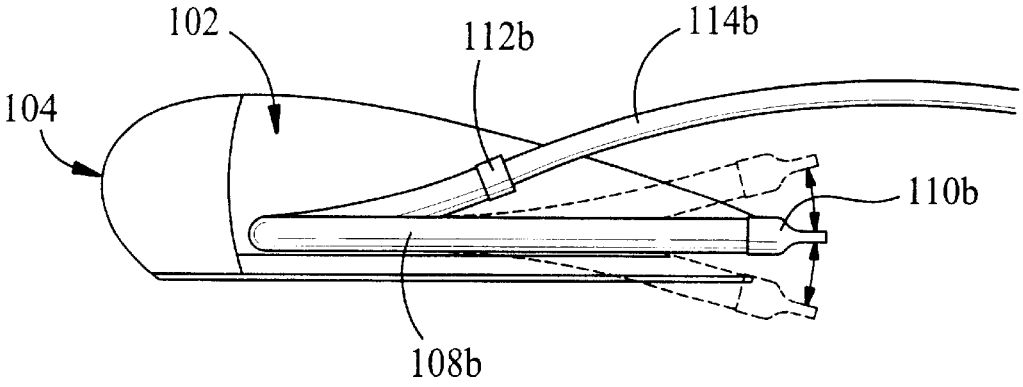
FIG. 3 is a cross-sectional side view of the embodiment of FIG. 1.

Referring to FIG. 3, jet nozzles 110*a* and 110*b* are directed substantially parallel to the longitudinal axis 100' and to the water surface on which the device 100 floats, in a direction opposite of the direction of travel 105, so as to propel the buoyant hull 102 across a surface. In other embodiments, as shown in FIG. 2, jet nozzles 110*a* and 110*b* may be directed at an angle away or toward the water surface to produce force tending to lift the bow up or push the bow down, giving the device 100 a tendency to lift out of a pool or off a surface in the former instance, or a tendency to stay in a pool or on or even under a surface in the latter. In still other embodiments, one or more jet nozzles may be aimed in other directions, and may be sized differently to produce a desired spray pattern. For example, jet nozzles may be directed outward from the sides of the buoyant hull 102, allowing additional control or maneuverability of the toy 100. In addition, jet nozzles maybe used for other purposes. For example, one or more jet nozzles may be directed outward from the bow to slow the device 100 or to act as a fire hose on a fireboat. Still further, one may design the device 100 with nozzles that are pivotable or movable to different positions either manually or by remote mechanism, including under electronic control.

Fittings 112*a* and 112*b* may be used to connect each tube 114*a* and 114*b* with each fluid communicator 108*a* and 108*b*. Fittings 112*a* and 112*b* are substantially similar, and may be pressure fittings, threaded screw-type fittings, quick disconnect ball-bearing fittings, or some other fitting providing a tight, leak-proof seal between each tube and each fluid communicator, in known fashion. In other embodiments, a tube 114*a* or 114*b* and a fluid communicator 108*a* or 108*b* may be a single piece, not requiring a fitting. Each tube 114*a* and 114*b* may be constructed from a flexible, light-weight material, allowing it to trail the buoyant hull 102 without substantially impeding forward or lateral movement of the device 100. For example, each tube 114*a* and 114*b* may be constructed of vinyl or flexible plastic tubing, in known fashion. In other embodiments, multiple tubes may be contained in a single conduit, or may be connected with one another to prevent entanglements.

FIG. 2 shows a detailed perspective view of an embodiment of an assembly 200 for coupling a remote fluid source 300 (e.g., pressurized water from a remote water spigot or air from a remote compressor, neither shown) via tubing 300 with tubes 114*a* and 114*b*. The assembly 200 includes a flow splitter 202, which is used to divide a single source of fluid provided by tubing 300 into two separate, substantially equal streams 202*a* and 202*b* diverging at an angle, which may be around 60 degrees, as shown. The splitter 202 may be constructed from a corrosion resistant material, for example, plastic, aluminum, or stainless steel. In other embodiments, the splitter 202 may cause the streams to diverge at a greater than sixty degree angle, or less than a sixty degree angle to improve fluid flow; for example, the streams may be set ninety degrees apart to allow a user to grasp the handles like a bicycle handlebar, or the streams may be set thirty degrees apart to minimize obstruction of flow. In still other embodiments, the splitter 202 may divide one or more sources of fluid into one or more streams.

The splitter 202 may have a fitting 208 on the proximal end allowing the splitter 202 to be connected with a pressure regulator 250. The splitter 202 may also have fittings 206*a* and 206*b* at the distal end of each stream 202*a* and 202*b* allowing the splitter to be coupled to tubes 114*a* and 114*b* via fittings 116*a* and 116*b*. Fittings 208, 206*a*, and 206*b* may be identical or different, and each may be a pressure fitting, threaded screw fitting, quick disconnect ball-bearing fitting, or other similar type providing a water-tight seal. Likewise, fittings 116*a* and 116*b* are coupled to fittings 206*a* and 206*b*, connecting tubes 114*a* and 114*b* with splitter 202. In other embodiments, tubes 114*a* and 114*b* and splitter 202 may be a single piece, and/or splitter 202 and pressure regulator 250 may be a single piece.

Streams 202*a* and 202*b* may each have a valve 204*a* or 204*b* to control the amount of flow through each stream and thus to each channel. By controlling the amount of flow through each stream, a user may control the propulsion of the device 100 and steer the device 100. The valves 204*a* and 204*b* may be substantially similar, and may be of any type allowing restriction of flow. For example, the valves 204*a* and 204*b* may be of a gate or ball type. The valves may be constructed of a corrosion resistant material, for example, plastic, aluminum, or stainless steel.

The assembly 200 may also include a pressure regulator 250, which may connect the splitter 202 with tubing or hose 300 that couples the device 100 to a remote source of pressurized water or air. The pressure regulator 250 may be constructed of a corrosion resistant material, for example, plastic, aluminum, or stainless steel. The pressure regulator 250 may have a cut-off valve 252 that is used to control the amount of flow to the splitter 202. The cut-off valve 252 may be of any type allowing restriction of flow. For example, the cut-off valve may be a gate or ball type valve. In other embodiments, the pressure regulator 250 and the splitter 202 may be a single piece. In still other embodiments, the splitter 202 may connect directly with the remote fluid source, eliminating the pressure regulator 250.

Those skilled in the art, however, will recognize that assembly 200 and its associated splitter 202 are unnecessary and that, instead, a piece of tubing 300 may be provided for each fluid communicator 108*a*, 108*b*. In FIG. 1, for example, two pieces of tubing 300 would be provided, one for fluid communicator 108*a* and one for 108*b*. Both pieces of tubing 300 could trail behind the buoyant hull 102 back to the fluid source where they could be joined together. Alternatively, each piece of tubing 300 could be coupled to its own remote fluid source. In this embodiment, tubes 114*a*, 114*b* and associated fittings 112*a*, 112*b*, 116*a*, 116*b* may be included or omitted. If the latter, tubing 300 would be joined directly to fluid communicators 108*a*, 108*b*.

In operation, the tubing 300 is used to provide pressurized fluid, e.g., water or air, from a remote source to the fluid communicators 108*a*, 108*b*. The fluid communicators 108*a*, 108*b* communicate the pressurized fluid to the jet nozzles 110*a*, 110*b*, which discharge the fluid into the surrounding atmosphere with sufficient velocity to propel the buoyant hull 102, which may be fitted with wheels, across the surface of a pool, pond, lake or other body of water, and also across concrete, dirt, or other hard and soft surfaces. By increasing pressure on the fluid, the jet nozzles 110*a*, 110*b* will discharge the water with greater velocity, providing additional thrust. The tubing 300 may be coupled directly or indirectly to a remote water spigot or air compressor. A remote control (not shown) may be coupled between the spigot or compressor and the tubing 300, allowing the user to regulate fluid flow and provide thrust to any selected jet nozzle 110*a*, 110*b* to turn the device 100 or allow it to dive under or jump off the surface across which the device is moving. Thus, the buoyant hull 102, once powered by the pressurized water, may be made to move about with great velocity, and can turn, climb, and dive under operator control.

A number of embodiments of the invention have been described. Nevertheless, it will be understood that various modifications may be made without departing from the spirit and scope of the invention. For example, in other embodiments, the splitter 202 and regulator 12 may be connected to an air source, or other propulsion medium. Accordingly, other embodiments are within the scope of the following claims.

What is claimed is:

1. A device comprising:

a buoyant hull;

at least one fluid communicator along the buoyant hull, having a proximal end and a distal end, for communicating fluid from the proximal end to the distal end;

a nozzle, coupled to the distal end of the fluid communicator, for discharging the fluid communicated to the distal end with sufficient velocity to propel the buoyant hull across a surface;

a tube, coupled to the proximal end of the fluid communicator, for providing fluid from a remote pressurized fluid source to the fluid communicator and thereby to the nozzle;

a wedge-shaped bow for enduring impacts;

a substantially flat bottom; and a recessed aft end for allowing unobstructed coupling of each fluid communicator to the tube.

2. The device of claim 1, wherein the fluid communicator is molded into the buoyant hull.

3. The device of claim 1, wherein the fluid communicator is fastened to the buoyant hull.

4. The device of claim 1, wherein two fluid communicators are provided along the buoyant hull, wherein the proximal end of each fluid communicator is directed toward an aft end of the buoyant hull, and wherein the distal end of each fluid communicator is directed toward the aft end of the buoyant hull.

5. The device of claim 1, wherein two fluid communicators are provided along the buoyant hull and two tubes are provided, an end of one tube being coupled to the proximal end of each fluid communicator, wherein the other end of each tube is coupled to distal ends of a fluid source splitter, and wherein a proximal end of the fluid source splitter is coupled to the pressurized fluid source.

6. The device of claim 5, wherein the source splitter comprises:

at least one stem at the proximal end for receiving and providing pressurized fluid;

a stream at each distal end, coupled to each tube, for receiving and providing pressurized fluid to the tube; and a valve, coupled in series with each stream, for controlling the flow of pressurized fluid to each tube.

7. The device of claim 6, wherein the proximal end of the source splitter is coupled to a regulator having a valve, coupled in series, for controlling flow to the source splitter.

8. The device of claim 1, wherein the remote pressurized fluid source includes a water spigot.

9. The device of claim 1, wherein the remote pressurized fluid source includes an air compressor.

10. The device of claim 1, wherein the fluid communicator and the tube are an integral unit.

11. A water toy, comprising:

a semi-submersible hull;

a plurality of fluid communicators along the semi-submersible hull, each having a proximal end and a distal end, for directing propellant flow;

a nozzle, coupled to the distal end of each fluid communicator, for discharging the fluid communicated to the distal end of the fluid communicator;

a tube, coupled to the proximal end of each fluid communicator at a first end of the tube and coupled to a stream splitter at a second end of the tube, for receiving and providing water from at least one remote water source;

a source splitter, coupled to the at least one remote water source, for directing flow to the tubes, wherein at least one nozzle is directed up and at least one nozzle is directed down for submerging and surfacing the semi-submersible hull.

12. The water toy of claim 11, wherein the source splitter is coupled to a regulator for controlling flow from the remote water source.

13. The water toy of claim 11, further comprising:

a valve, coupled in series with each tube and the source splitter, for controlling flow to one or more channels.

* * * * *